US012053689B1

(12) United States Patent
Oliphant

(10) Patent No.: US 12,053,689 B1
(45) Date of Patent: Aug. 6, 2024

(54) METHOD AND APPARATUS FOR A SKATEBOARD TRUCK

(71) Applicant: Thomas J Oliphant, Chandler, AZ (US)

(72) Inventor: Thomas J Oliphant, Chandler, AZ (US)

( * ) Notice: Subject to any disclaimer, the term of this patent is extended or adjusted under 35 U.S.C. 154(b) by 0 days.

(21) Appl. No.: 18/539,109

(22) Filed: Dec. 13, 2023

Related U.S. Application Data

(60) Provisional application No. 63/587,498, filed on Oct. 3, 2023.

(51) Int. Cl.
*B62K 5/10* (2013.01)
*A63C 17/00* (2006.01)
*A63C 17/01* (2006.01)

(52) U.S. Cl.
CPC ..... *A63C 17/0046* (2013.01); *A63C 17/012* (2013.01); *A63C 17/015* (2013.01); *A63C 2203/20* (2013.01)

(58) Field of Classification Search
CPC . A63C 17/0046; A63C 17/012; A63C 17/015; A63C 17/01; A63C 17/011; A63C 2203/20
See application file for complete search history.

(56) References Cited

U.S. PATENT DOCUMENTS

| | | | | |
|---|---|---|---|---|
| 5,263,725 | A * | 11/1993 | Gesmer | A63C 17/015 280/11.28 |
| 7,073,805 | B2 * | 7/2006 | Yan | A63C 5/04 280/221 |
| 11,851,126 | B2 * | 12/2023 | Newby | B62K 3/002 |
| 2012/0086181 | A1 * | 4/2012 | Kinnaman | A63C 17/0033 29/428 |
| 2016/0206949 | A1 * | 7/2016 | Murphy | A63C 17/015 |
| 2016/0318562 | A1 * | 11/2016 | Mainville | A63C 17/0046 |
| 2019/0351314 | A1 * | 11/2019 | Lewis | A63C 17/012 |
| 2021/0046994 | A1 * | 2/2021 | Virag | A63C 17/015 |
| 2021/0291926 | A1 * | 9/2021 | Newby | B62K 5/027 |

FOREIGN PATENT DOCUMENTS

CN 215185704 U 12/2021

* cited by examiner

*Primary Examiner* — Brian L Swenson
(74) *Attorney, Agent, or Firm* — Inspired Idea Solutions Law Firm

(57) ABSTRACT

A skateboard includes a deck, one or more wheels, and a truck coupled to the deck and to the one or more wheels. The truck has a base plate for coupling to the deck, an axle for coupling to the one or more wheels, and a shaft secured to the base plate at one end, and to the axle at the other end. The shaft is capable of rotational movement with respect to the base plate about a first axis. The axle is capable of rotational movement with respect to the shaft about a second axis. First and second linkages extend from the base plate to the axle. The shaft and the first and second linkages work together to convert a leaning motion of the deck into a turning motion of the axle to control steering of the skateboard during use.

20 Claims, 9 Drawing Sheets

METHOD AND APPARATUS FOR A SKATEBOARD TRUCK

FIELD

The present disclosure generally relates to skateboards, and more particularly to a skateboard truck for improved stability and handling.

BACKGROUND

Skateboarding originated in California in the 1940s as an offshoot of surfing ("asphalt surfers"). Since that time skateboards have changed only modestly in shape and operability. The kicktail was added in the 1960s. Urethane wheels were added in the 1970s. Subtle changes in the shape of the skateboard also occurred in the 1970s, such as increases in width and concavity along the board. More recently skateboards have been fitted with electronic motors and wireless hand-held throttle remote transmitters. Skateboards are no longer just a toy, but are used frequently to travel longer distances at consistently higher speeds.

Skateboards have 3 key components, the deck or board, the wheels, and the truck. The "truck" refers to the component that connects the wheels to the deck. One of the early truck designs is the Traditional Kingpin, which incorporates a baseplate with a kingpin and a pivot cup and a hanger suspended between the kingpin and the pivot cup so that the wheel axis is between the kingpin and the pivot cup. Another design is the reverse kingpin, which employs similar components, but has the kingpin located between the wheel axis and the pivot cup. Further, a double kingpin utilizes the traditional kingpin configuration extending from a second group of kingpin and pivot cup in a stacked orientation.

It is generally understood in the art that a bushing, or a pair of bushings are used to hold the hanger and the kingpin, and a bushing holds a spiked portion of the hanger within the pivot cup. The bushings flex and compress to allow motion of the hanger with respect to the baseplate. In this way applying pressure to different parts of the deck will cause the flexing or compression of the bushings and further movement of the hanger. Movement of the hanger results in slight twisting of the wheel axis with respect to the deck, such as to provide turning of the skateboard.

Three link trucks differ in design than the designs previously presented, however they still rely on a bushing to connect the base plate to the wheel axis.

While the above designs have been in common use for many years, they also provide challenges to skateboard users during operation. Existing designs may be dangerously unstable at high speeds, both when the skateboard is traveling straight and especially when turning, as the bushings and other components tend to wear out quickly. Existing designs also tend to cause sudden onset speed wobbles which can cause loss of control of the skateboard during use, which may result in crashes and/or serious bodily injury to the user. This is particularly true at the higher speeds achieved by skateboards having electronic motors. Existing designs may also be poorly engineered, have poor quality of components, insufficient testing, and other performance related issues. Skateboards with electric motors are capable of much higher speeds, but are also fraught with battery issues, speed control issues, and motor drive train complications that may lead to excessive malfunction and premature breakdown.

Therefore, a need exists to improve upon the truck design to increase safety and reliability during skateboard operation.

SUMMARY

A skateboard comprising a deck, one or more wheels, and a truck coupled to the deck and the one or more wheels, the truck having a base plate coupled to the deck, an axle coupled to the one or more wheels, a shaft extending from the base plate to the axle, the shaft capable of rotational movement with respect to the base plate about a first axis, and the axle capable of rotational movement with respect to the shaft about a second axis not parallel to the first axis, and one or more linkages extending from the base plate toward the axle to cause turning of the axle in response to tilting of the base plate.

A skateboard truck coupled to a deck and one or more wheels, the truck comprising a base plate coupled to the deck, an axle coupled to the one or more wheels, a shaft extending from the base plate to the axle, the shaft capable of rotational movement with respect to the base plate about a first axis, and the axle capable of rotational movement with respect to the shaft about a second axis not parallel to the first axis, and one or more linkages extending from the base plate toward the axle to cause turning of the axle in response to tilting of the base plate.

A method of assembling a skateboard truck, the method comprising providing a base plate, extending a shaft from the base plate, the shaft configured for rotational movement with respect to the base plate about a first axis, extending the shaft to an axle, the axle configured for rotational movement with respect to the shaft about a second axis not parallel to the first axis, and providing one or more linkages extending from the base plate toward the axle to cause turning of the axle in response to tilting of the base plate.

BRIEF DESCRIPTION OF THE DRAWINGS

Various aspects and advantages will become apparent upon review of the following detailed description and upon reference to the drawings in which.

DETAILED DESCRIPTION

Figure 1:
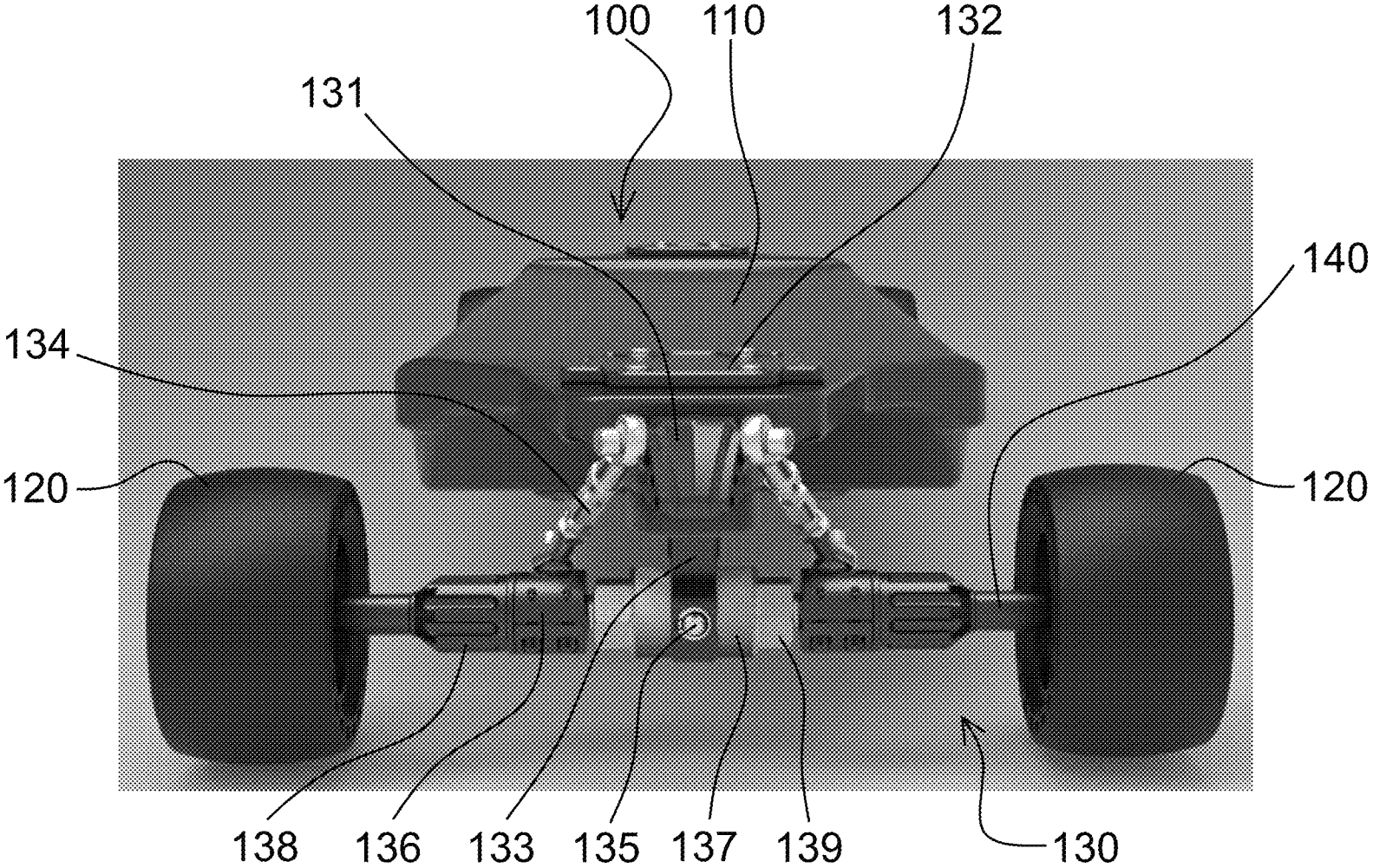
FIG. 1 illustrates a front view of a skateboard assembly.

The following disclosure may include a method and apparatus for a skateboard truck. The skateboard truck presented in this disclosure improves stability and handling during use, thus improving performance and safety. The truck may be used to couple one or more wheels to a deck in such a way as may enable steering of the wheels by changing pitch of the deck, and further may avoid sudden onset speed wobbles.

A skateboard may include a deck and one or more wheels (e.g., four wheels), and may further include one or more trucks for coupling the one or more wheels to the deck (e.g., two trucks, with each truck coupling two wheels). The one or more trucks may be coupled and discrete positions along the length of the deck (e.g., at a forward position, at a rearward position). A first truck may be coupled at a forward position (e.g., at a front of the deck). A second truck may be coupled at a rearward position (e.g., at a back of the truck, or oppositely of the first truck). Positioning of the first and second trucks may enable optimized handling of the skateboard during use.

Each of the one or more trucks may include some or all of the features presented in this disclosure. The trucks may include a base plate configured for attachment to the deck. The base plate may be connected to the bottom of the deck. The base plate may extend below and/or outwardly (e.g., forward, rearward) from the deck.

A shaft may be coupled to the base plate. The shaft may extend outward from the base plate. The shaft may extend downward, forwardly, and/or rearwardly from the base plate. The shaft may be configured for rotational movement with respect to the base plate about a shaft axis (e.g., the shaft axis extending longitudinally through the length dimension of the shaft). The shaft axis may be vertical or horizontal. Rotational movement may be provided by the use of one or more bearings to secure the shaft to the base plate while allowing rotation of the shaft. The shaft may include an eye at one end (e.g., the end opposite of the base plate).

An axle may extend through the eye of the shaft. An approximate center point of the axle may be positioned at the eye of the shaft, such that about half the axle may extend from the eye in a first direction and about half the axle may extend from the eye in an opposite direction to the first direction. The axle may be pinned in place (e.g., by a pin extending through the axle and the eye of the shaft, by a fish eye rod end heim tie rod end, or by other connections which enable adequate rotation and proper function). The axle may be configured for rotational movement with respect to the shaft about a pin axis (e.g., the pin axis extending longitudinally through the length dimension of the pin). The pin axis may be horizontal. The pin axis may be offset from horizontal. The shaft axis may be orthogonal to the pin axis.

One or more linkages may extend from the base plate to the axle. The linkages may include a component enabling spherical rotation (e.g., a fish eye rod end) at each end of the linkages to enable rotational securement to the base plate and to the axle. Each linkage may be secured directly to the base plate. Each linkage may be secured indirectly to the axle (e.g., secured to a sleeve surrounding the axle, which may fix its connection point along the length of the axle, but may still allow the axle to rotate within the sleeve). The one or more linkages may include two linkages for each axle. The linkages may extend from the base plate outward, or away from each other to the axle (e.g., the connection points on the base plate may be relatively close together, and the connection points on the axle may be relatively farther apart). The linkages may extend from the base plate inward, or toward each other to the axle (e.g., the connection points on the base plate may be relatively farther apart, and the connection points on the axle may be relatively close together). The linkages and the axle may collectively form an approximately triangular shape.

The linkages may be adjustable, and may influence turning of the axle relative to the base plate, and may cause turning of the skateboard. Modifying the angle of the linkages with respect to each other may have an impact on the turning radius of the skateboard, turning sensitivity, and high-speed stability. Increasing the relative angle of the linkages may increase the turning radius, increase sensitivity, and lower stability. Decreasing the relative angle of the linkages may decrease the turning radius, decrease sensitivity, and improve stability. Where a skateboard has two trucks (e.g., a forward truck and a rearward truck), and where each truck has a pair of linkages to enable steering, the relative angle of the linkages in the forward pair of linkages may be different than the relative angle of the linkages in the rearward pair of linkages. The relative angle of the linkages in the forward pair of linkages may be greater than the relative angle of the linkages in the rearward pair of linkages. The relative angle of the linkages in the forward pair of linkages may be between about 1 and 5 times the relative angle of the linkages in the rearward pair of linkages. The relative angle of the linkages in the forward pair of linkages may be about 3 times the relative angle of the linkages in the rearward pair of linkages.

FIG. 1 illustrates a front view of a skateboard 100 having a deck 110, one or more wheels 120, and at least one truck 130. Deck 110, the one or more wheels 120, and truck 130 may be formed of any one or more of metal, wood, plastic, or composite materials. Truck 130 is illustrated extending below deck 110, though other orientations are possible. In general truck 130 may provide securement of wheels 120 to deck 110. Truck 130 may also provide steering of skateboard 100.

Truck 130 may include a base plate 131. Base plate 131 may be secured to the bottom side of deck 110, though other orientations are possible. Base plate 131 may be secured to a top plate 132. Top plate 132 may be positioned on a top side of deck 110. Top plate 132 and base plate 131 may be secured to each other through deck 110 (e.g., by bolts extending through deck 110). Base plate 131 may be configured to receive a shaft 133.

Shaft 133 may be secured to base plate 131 for rotational movement (e.g., about a vertical axis). Shaft 133 may extend below base plate 131 to an axle 140. Shaft 133 may have two opposing ends. A first end of shaft 133 may be configured to interconnect with base plate 131, and a second end of shaft 133 may be configured to interconnect with axle 140. One end of shaft 133 may be formed into a hollow ring (e.g., an eye) for receiving the axle 140 therethrough.

Axle 140 may extend through the hollow ring of shaft 133 (e.g., to a center point along the length of axle 140). A pin 135 may extend through the hollow ring portion of shaft 133 and further may extend through axle 140. Axle 140 may be configured for rotational movement with respect to shaft 133 about a horizontal axis (e.g., the horizontal axis extending through the pin along its length).

Relative motion of axle 140 and shaft 133 may be damped by one or more bushings 137. Bushings 137 may be positioned around axle 140 on either side of shaft 133, or may be positioned on both sides of shaft 133. Each bushing 137 may be held in place by a securing ring 139 extending around axle 140 (e.g., a threaded nut, a threaded lock-nut). Bushings 137 may be compressed toward shaft 133 by the securing rings 139 on each side of the assembly (e.g., one on the right side, and one on the left side). Securement of bushings 137 by securing rings 139 may cause shaft 133 to be biased into an orthogonal position with respect to axle 140. Application of a force to shaft 133 and/or axle 140 may cause shaft 133 to move to some other angle with respect to axle 140 (e.g., less than or greater than ninety degrees).

One or more linkages 134 may extend from the base plate to the axle. At each end of the linkages 134 a ball joint (e.g., a fish eye rod end) may enable spherical rotation of the linkage 134 with respect to the component to which it is connected (e.g., the base plate 131 and/or the axle 140). Linkage 134 may be secured to be in direct contact with base plate 131 (e.g., by a bolt passing through the fish eye and holding it against base plate 131). Linkage 134 may be secured without direct contact with axle 140. Linkage 134 may be secured to be in direct contact with a sleeve 136 (e.g., by a bolt passing through the fish eye and holding linkage 134 against sleeve 136).

Sleeve 136 may extend around axle 140. Sleeve 136 may be secured to axle 140. Sleeve 136 may not rotate around axle 140, but may be clamped tightly to axle 140. Thus, linkage 134 may be fixed at each end, where one end may be pinned to base plate 131 and the opposing end may be pinned to axle 140 (e.g., pinned to a discrete position along the length of axle 140). Where two linkages 134 are connected between base plate 131 and axle 140, each linkage 134 may have a corresponding sleeve 136, such that each linkage 134 may move independently of the other.

A spacer 138 may be connected to axle 140. Spacer 138 may enclose axle 140. Spacer 138 may protect axle 140 from impacts during use of the skateboard 100 (e.g., impacts resulting from rough terrain).

Figure 2:
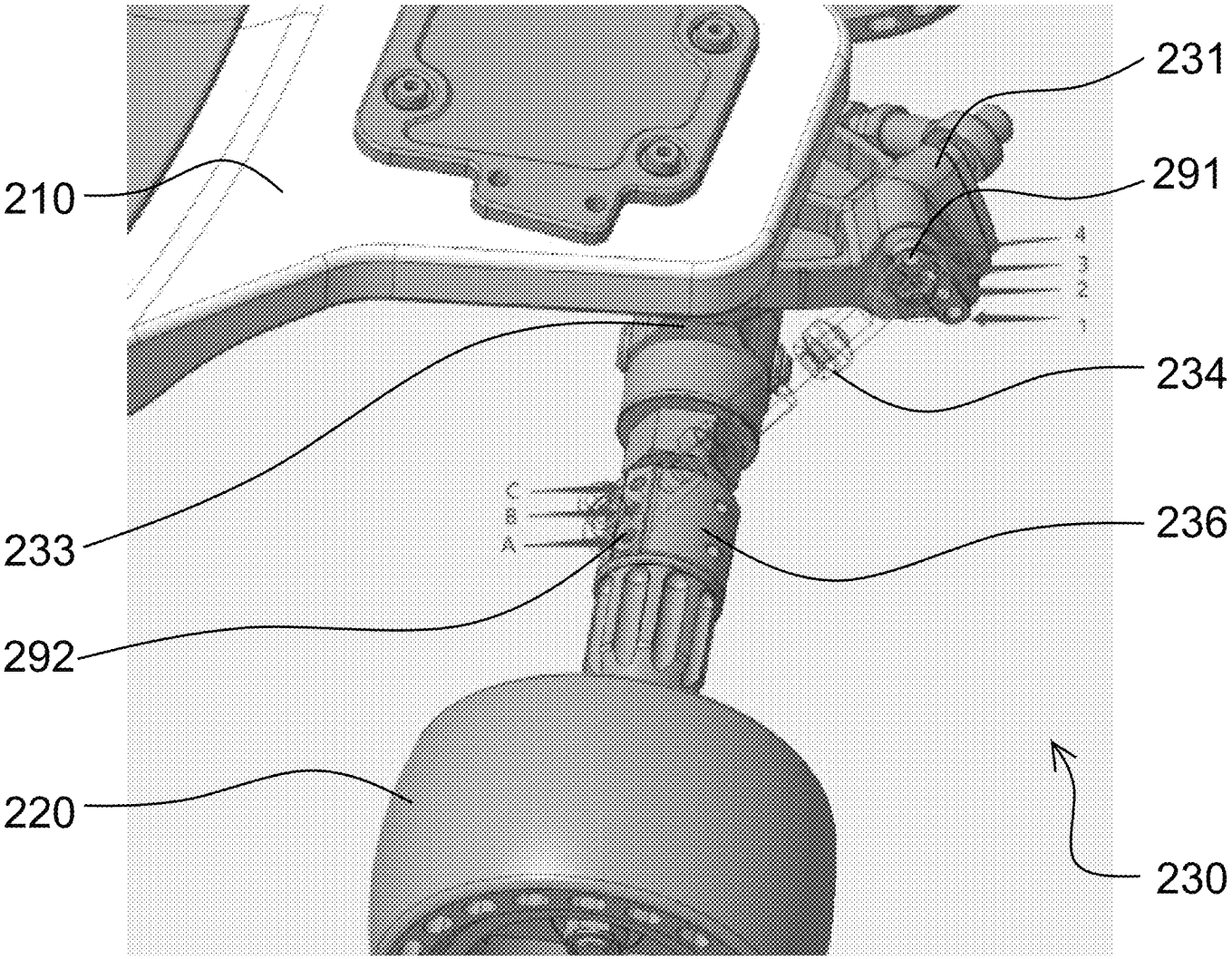
FIG. 2 illustrates a side view of a truck used for coupling wheels and a deck of a skateboard assembly.

FIG. 2 illustrates a side view of a truck 230 used for coupling wheels 220 and a deck 210 of a skateboard (e.g., skateboard 100 of FIG. 1). Truck 230 may include a base plate 231. Base plate 231 may be secured to deck 210. A shaft 233 may be connected to base plate 231. Shaft 233 may extend from base plate 231 to an axle (e.g., axle 140 of FIG. 1). The axle may extend through and/or interconnect with shaft 233. A sleeve 236 may extend around and/or be secured to the axle.

A linkage 234 (illustrated in phantom lines) may extend from base plate 231 to sleeve 236. Linkage 234 may be connected to base plate 231 at any one of one or more connection points 291 (e.g., 4 connection points, illustrated with numerical indicators 1, 2, 3, and 4). Linkage 234 may be connected to sleeve 236 at any one of one or more connection points 292 (e.g., 3 connection points, illustrated with alphabetic indicators A, B, and C). Selection of different combinations of connections points when affixing linkage 234 to base plate 231 and sleeve 236 may impact the angle of linkage 234 with respect to the axle. The angle of linkage 234 with respect to the axle may impact the mechanical advantage associated with turning the skateboard (e.g., changing the turning radius of the skateboard, adjusting sensitivity, and/or changing stability while turning).

Figure 3:
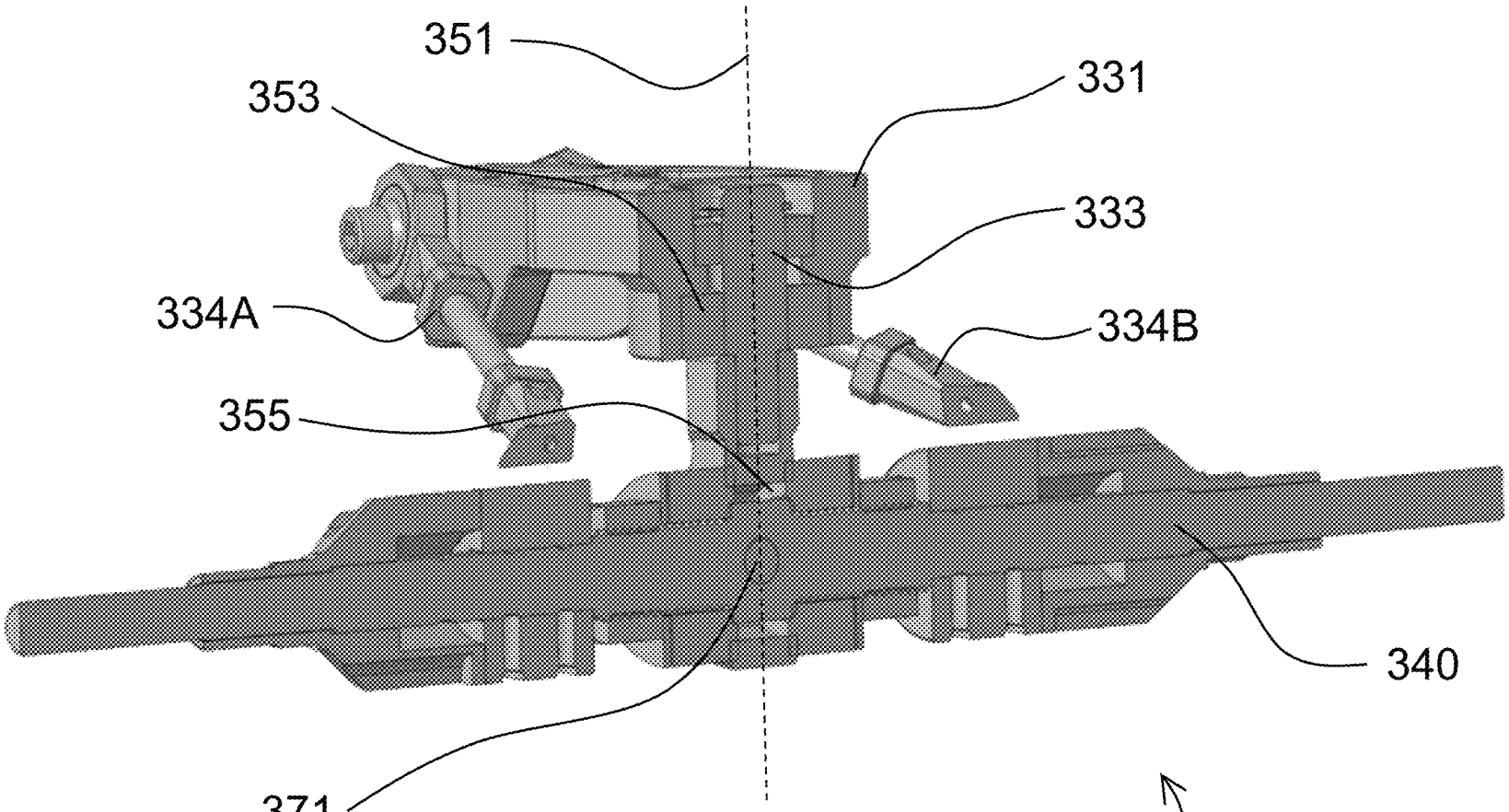
FIG. 3 illustrates a cross-sectional view of a truck used for coupling wheels and a deck of a skateboard assembly.

FIG. 3 illustrates a cross-sectional view of a truck 330 used for coupling wheels and a deck of a skateboard assembly. The truck 330 may include a base plate 331, a shaft 333, and an axle 340. The shaft 333 may be rotatable about a shaft axis 351. Shaft 333 may be secured to base plate 331 and configured for rotation through the use of one or more bearings 353. Axle 340 may be secured to shaft 333. Axle 340 may extend through a hole 355 in shaft 333. Axle 340 may be pinned to shaft 333 (e.g., by a pin 371). Axle 340 may be rotatable about a pin axis (e.g., as exemplified in FIG. 4).

Linkages 334A, 334B may extend from base plate 331 to axle 340 (though the full span isn't fully represented due to the cross-sectional nature of the figure). The combination of shaft 333 and linkages 334A, and 334B as they are connected to base plate 331 and axle 340 work together to produce a very precise movement of the parts. Shaft 333 and base plate 331 may lean rightward or leftward during operation, which may represent a rotation about the pin axis. The leaning motion also causes movement of linkages 334A, 334B, which may push and/or pull on axle 340. The pushing and/or pulling on axle 340 may cause axle 340 to rotate with respect to base plate 331. Rotation of axle 340 with respect to base plate 331 may cause shaft 333 to rotate with respect to base plate 331 (e.g., as facilitated by bearing 353).

In a specific example, where shaft 333 and base plate 331 lean leftward (e.g., due to forces applied by the user), the perpendicular orientation of shaft 333 and axle 340 may change to an acute orientation (e.g., the 90 degree angle is reduced). As the shaft 333 and base plate 331 lean leftward, the first linkage 334A may be pushed while the second linkage 334B may be pulled. The first linkage 334A may be pushed because the leftward lean may cause the base plate 331 to attempt to move toward the connection point of first linkage 334A with axle 340 (e.g., if first linkage 334A were removed, base plate 331 may move toward the connection point of first linkage 334A with axle 340). However, because of the presence of first linkage 334A, axle 340 may instead be pushed by first linkage 334A backward (e.g., out of the page).

The opposite motion may be true for second linkage 334B, since the leftward lean may cause the base plate 331 to attempt to move away from the connection point of the second linkage 334B with axle 340. Therefore, the presence of second linkage 334B may cause axle 340 to be pulled forward (e.g., into the page). In this scenario, the pushing by linkage 334A and pulling by linkage 334B may cause a rotation of axle 340 about the shaft axis 351 and a rotation of shaft 333 about the shaft axis 351 (e.g., a counterclockwise rotation about the shaft axis 351 when viewed from above, corresponding to a leftward turn of the skateboard).

In another specific example, a rightward lean of base plate 331 may produce the opposite result to that of the leftward lean (e.g., a clockwise rotation about the shaft axis 351 when viewed from above, corresponding to a rightward turn of the skateboard).

Figure 4:
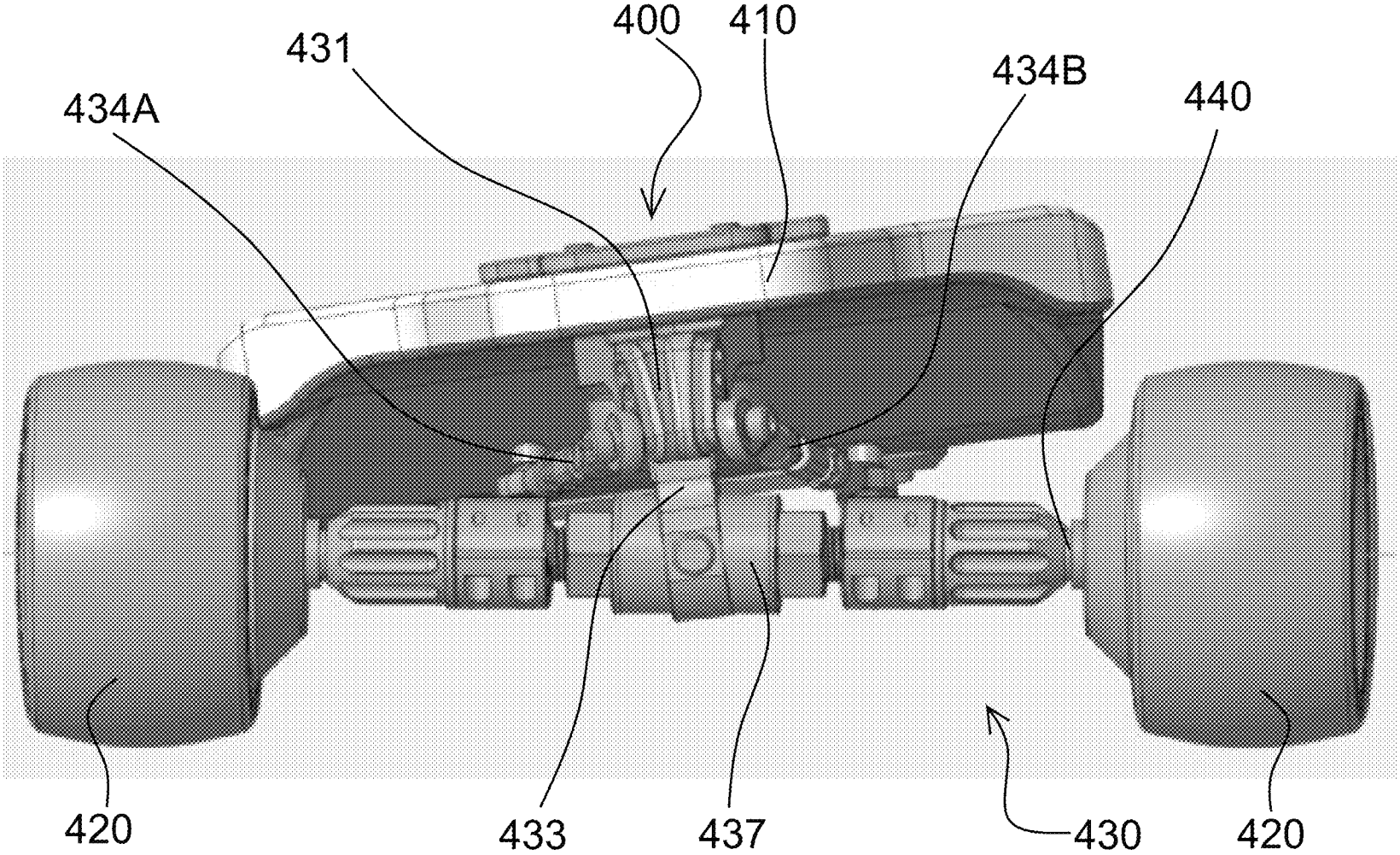
FIG. 4 illustrates a front view of an electric skateboard assembly.

FIG. 4 illustrates a front view of a skateboard 400 having a deck 410, one or more wheels 420, and a truck 430. In general truck 430 may provide securement of wheels 420 to deck 410. Truck 430 may also provide steering of skateboard 400. During operation, a user of skateboard 400 may apply weight (e.g., a force) to deck 410. When weight is evenly distributed, a deck may be biased into a horizontal position (e.g., as exemplified in FIG. 1, and as discussed with reference to bushings 137). When weight is unevenly distributed (e.g., shifted laterally to either side of skateboard 400), deck 410 may lean laterally (e.g., as exemplified in FIG. 2).

Truck 430 may include a base plate 431 secured to the underside of deck 410. Truck 430 may include a shaft 433 secured to base plate 431. Truck 430 may include an axle 440 secured to shaft 433. Truck 430 may include a first linkage 434A secured to the base plate 431 and to the axle 440 on one side of the assembly. Truck 430 may include a second linkage 434B secured to the base plate 431 and to the axle 440 on an opposing side of the assembly. Truck 430 may include bushings 437 secured to and extending around axle 440 on both sides of shaft 433.

The leaning of deck 410 due to uneven weight distributions may cause base plate 431 and/or shaft 433 to lean in a common direction (e.g., leftward as exemplified in the view of FIG. 4). As base plate 431 leans, first linkage 434A and second linkage 434B may be pushed and/or pulled (e.g., first linkage 434A may be pushed rearwardly into the page, and second linkage 434B may be pulled forwardly out of the page). The pushing and/or pulling of the first and second linkages 434A, 434B may cause a rotation of axle 440 (e.g., with the left side wheel 420 moving rearward into the page, and the right side wheel 420 moving forward out of the page).

Bushings 437 may provide some resistance against rotation of shaft 433 with respect to axle 440 (e.g., corresponding to leaning of deck 410). Yet, bushings 437 may conform and/or deflect in response to rotation of shaft 433.

Figure 5:
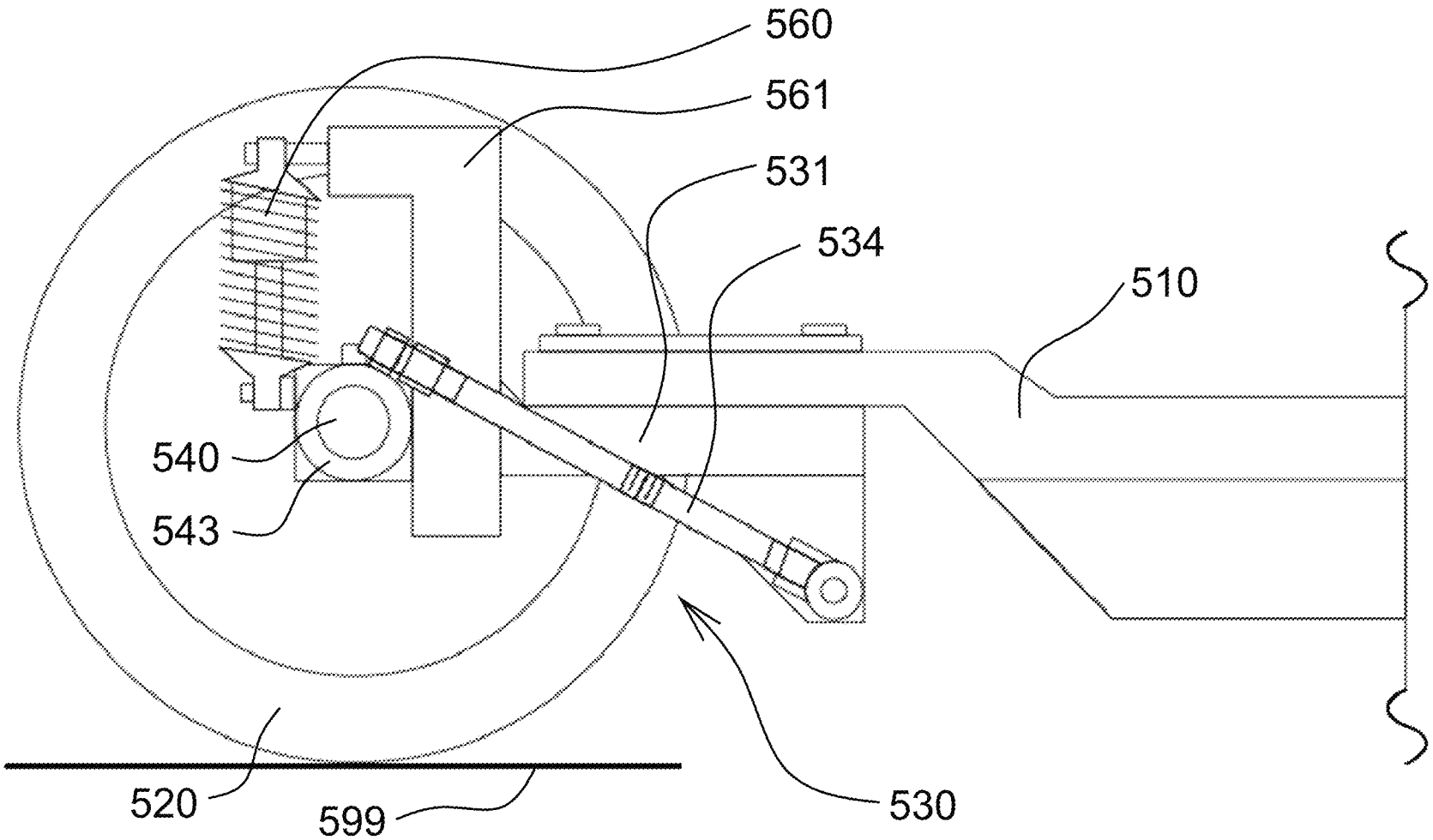
FIG. 5 illustrates a side view of an alternative truck used for coupling wheels and a deck of a skateboard assembly.

FIG. 5 illustrates a side view of a truck 530 used for coupling wheels 520 and a deck 510 of a skateboard assembly (e.g., skateboard 100 of FIG. 1). Truck 530 may have shocks 560 extending from a support element 561 to an axle 540. Support element 561 may be coupled to a base plate 531 (e.g., secured in a rigid relationship with deck 510).

Axle 540 may be coupled to the base plate 531 or equivalent structure in a manner that permits movement of axle 540 (e.g., permitting rotation). Axle 540 may extend through a ring at one end of base plate 531 as described in this disclosure. Axle 540 may extend through a ring at one end of a shaft (e.g., configured for rotation about a pin axis extending vertically), and the shaft may be configured for rotation with respect to base plate 531 (e.g., configured for rotation about a shaft axis extending horizontally). Axle 540 may be secured to base plate 531 by a spherical-type joint 543 (e.g., permitting rotational motion about multiple axes and/or rotational motion about a center point of the sphere). The connection of axle 540 to base plate 531 may provide a precise roll center for deck 510.

One or more wheels 520 may be rotatably coupled to axle 540 to permit the skateboard to travel across the ground 599. One or more linkages 534 may extend from base plate 531 to axle 540 to assist in stabilization and steering of axle 540 in response to tipping and/or swaying of deck 510.

Shocks 560 may bias axle 540 into a normal position (e.g., axle 540 extending perpendicularly to base plate 531). In previous embodiments, axle 540 may have been normalized by the use of one or more bushings located at the connection point of the axle to the shaft, as exemplified in FIGS. 3 and 4. In FIG. 5, bushings are no longer needed, since shocks 560 may provide the biasing force to normalize axle 540 with respect to base plate 531.

Yet, the operability of the skateboard assembly is similar. As deck 510 sways, tips, or leans to the right or to the left, axle 540 may rotate with respect to base plate 531. The rotational motion may be damped, controlled, and/or stabilized by shocks 560, linkages 534, or both. This arrangement increases precise compression and rebound adjustability allowing the user of the skateboard assembly to optimize the lean and/or deck tilt for very smooth, stable, and controlled turning with confidence that no sudden onset speed wobbles will occur.

Figure 6:
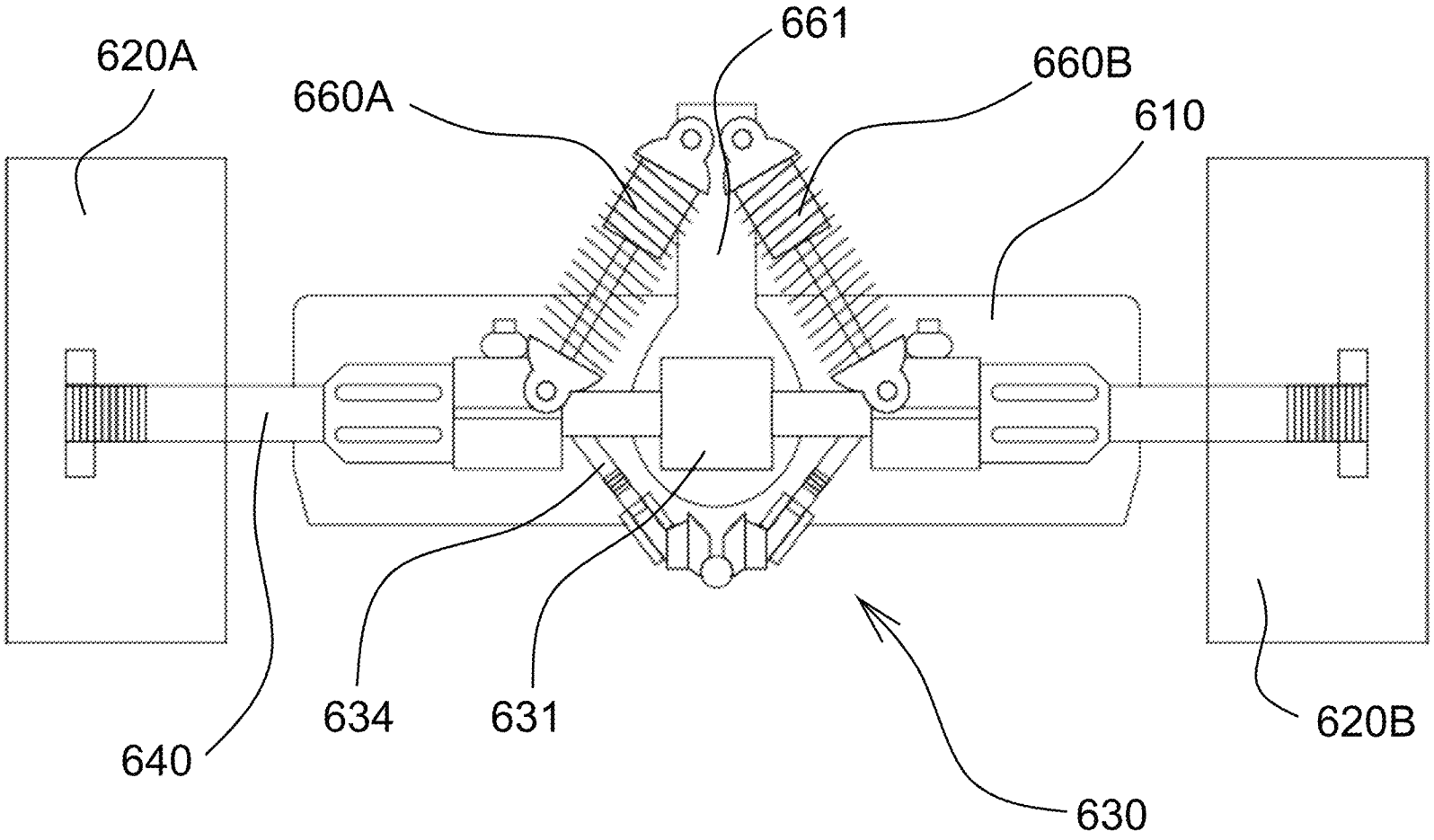
FIG. 6 illustrates a front view of an alternative truck used for coupling wheels and a deck of a skateboard assembly.

FIG. 6 illustrates a front view of a truck 630 used for coupling wheels 620A, 620B to a deck 610 of a skateboard. Truck 630 may have shocks 660A, 660B extending from a support element 661 to an axle 640. Support element 661 may be secured in a rigid relationship with the deck 610 and/or a base plate 631 extending from deck 610. Axle 640 may be coupled to the support element 661 in a manner that permits movement of axle 640 (e.g., permitting rotational movement). Axle 640 may extend through a ring at one end of base plate 631. Axle 640 may extend through a ring at one end of a shaft (e.g., configured for rotation about a pin axis), and the shaft may be configured for rotation with respect to base plate 631 (e.g., configured for rotation about a shaft axis). The pin axis and the shaft axis may be orthogonal to each other. Axle 640 may be secured to base plate 631 by a spherical-type joint (e.g., permitting rotational motion about multiple axes and/or rotational motion about a center point providing a precise roll center).

One or more wheels 620A, 620B may be rotatably coupled to axle 640 to permit the skateboard to travel across a surface. One or more linkages 634 may extend from base plate 631 to axle 640 to assist in stabilization and steering of axle 640 in response to tipping, leaning and/or swaying of deck 610.

A first shock 660A may extend from support element 661 downward and/or laterally to a position on axle 640 relatively close to a first wheel 620A. A second shock 660B may extend from support element 661 downward and/or laterally to a position on axle 640 relatively close to a second wheel 620B (e.g., the second shock 660B positioned oppositely of the first shock 660A on opposing sides of axle 640). Shocks 660A, 660B may be secured to support element 661 relatively close together, and may be secured to axle 640 relatively farther away. Shocks 660A, 660B and axle 640 may approximately form a triangular shape.

Shocks 660A, 660B may bias axle 640 into a normal and/or orthogonal position (e.g., axle 640 extending perpendicularly to base plate 531 and/or relative to the long dimension of deck 610). Shocks 660A, 660B may provide the biasing force needed to normalize axle 640 with respect to base plate 631 and/or deck 610. As deck 610 sways, tips, or leans to the right or to the left, axle 640 may rotate with respect to base plate 631.

The rotational motion may be damped, controlled, and/or stabilized by shocks 660A, 660B, linkages 534, or by all, and may provide for high-speed turning without the need for bushings anywhere in the assembly. This arrangement increases precise compression and rebound adjustability allowing the user of the skateboard assembly to optimize the lean and/or deck tilt for very smooth, stable, and controlled turning. This orientation may improve stability and maximize the mechanical advantage of shock absorption, minimizing and/or eliminating any sudden onset speed wobbles felt by the user of the skateboard during use (e.g., racing), thereby maximizing confidence in the skateboard performance and operability without fear of crashing or bodily injury.

Figure 7:
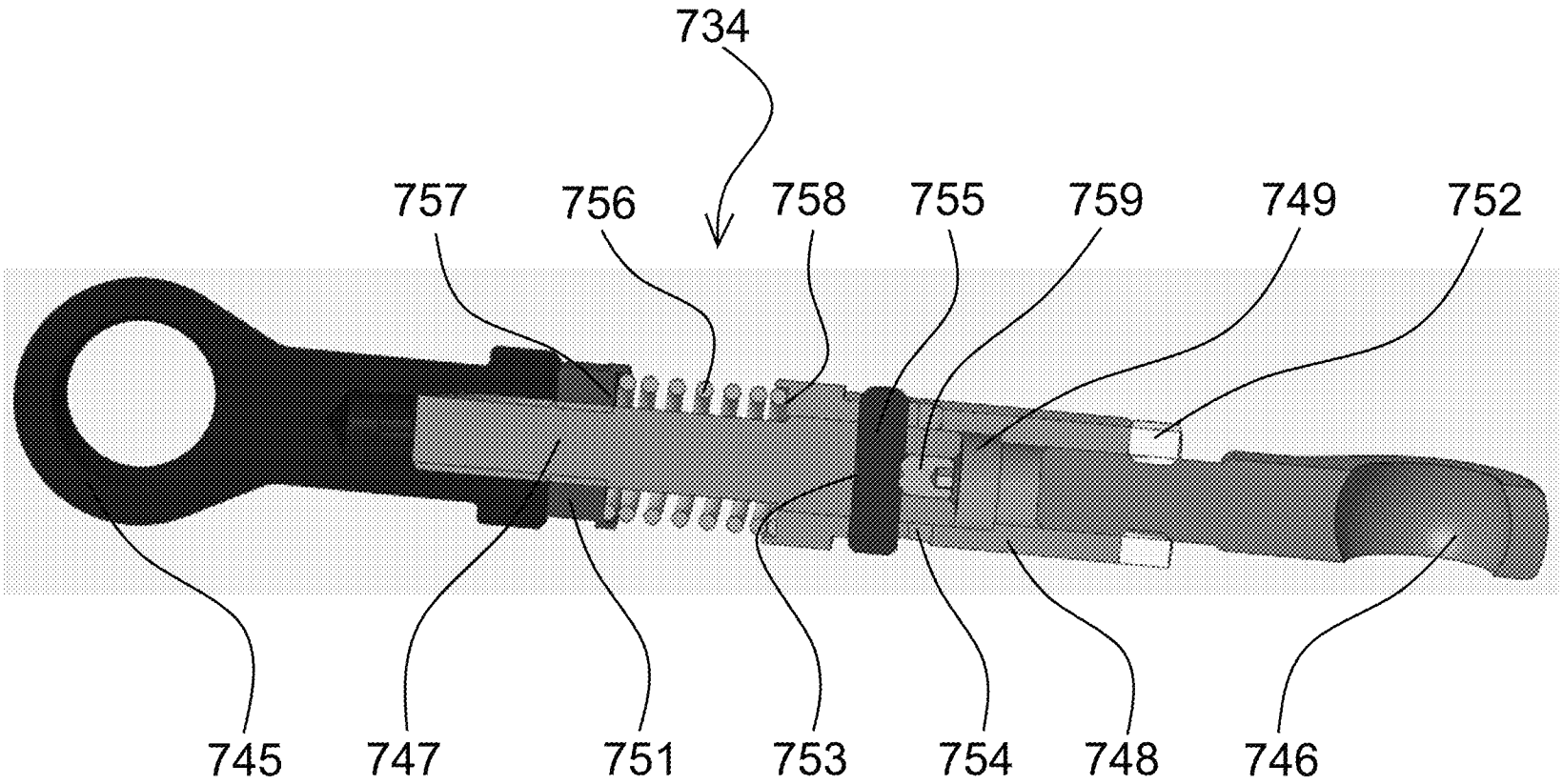
FIG. 7 illustrates a cross-sectional view of a linkage used for coupling wheels and a deck of a skateboard.

FIG. 7 illustrates a cross-sectional view of a linkage 734 used for coupling wheels (e.g., wheels 820 of FIG. 8) to a deck (e.g., deck 810) of a skateboard. Linkage 734 may have a first eyelet 745 which may be configured to couple to a first structural element of the skateboard (e.g., to base plate 831 of FIG. 8). Linkage 734 may have a second eyelet 746 which may be configured to couple to a second structural element of the skateboard (e.g., to sleeve 836 of FIG. 8). One or both of the first eyelet 745 and the second eyelet 746 may be capable of spherical rotational movement with respect to the structural element to which it is attached (e.g., such as with a fish eye rod end).

A piston 747 may extend from one of the first and second eyelets 745, 746. In FIG. 7, piston 747 is exemplified as extending from first eyelet 745. A piston cylinder 748 may extend from the other of the first and second eyelets 745, 746. In FIG. 7, piston cylinder 748 is exemplified as extending from the second eyelet 746. Piston 747 and piston cylinder 748 may be coupled to the corresponding eyelet by any means known in the art (e.g., threadably inserted, where a threaded portion of the corresponding eyelet interconnects with a threaded portion of the piston 747 or piston cylinder 748). In FIG. 7, piston 747 and piston cylinder 748 are exemplified as being inserted into the first and second eyelets 745, 746, respectively, though this disclosure contemplates other configurations. Piston 747 may be coupled to the corresponding eyelet at a first end of piston 747. Piston cylinder 748 may be coupled to the corresponding eyelet at a first end of piston cylinder 748.

A first retainer 751 may be coupled to piston 747 (e.g., threadably coupled). First retainer 751 may be positioned in an abutting relationship with the eyelet to which piston 747 is coupled (e.g., first eyelet 745). With first retainer 751 and first eyelet 745 threadably coupled to piston 747 (e.g., as exemplified in FIG. 7), first retainer 751 may be threadably tightened until a surface of first retainer 751 abuts a surface of first eyelet 745 (e.g., into frictional engagement). The frictional engagement of first retainer 751 with first eyelet 745 while both are threadably engaged on piston 747 may fix piston 747 and prevent relative movement of piston 747 with respect to first eyelet 745.

A second retainer 752 may be indirectly coupled to piston cylinder 748 (e.g., into frictional engagement). Second retainer 752 may be positioned in an abutting relationship with piston cylinder 748, with second retainer 752 and piston cylinder 748 coupled to a corresponding eyelet (e.g., second eyelet 746). With second retainer 752 and piston cylinder 748 threadably coupled to second eyelet 746 (e.g., as exemplified in FIG. 7), second retainer 752 may be threadably tightened until a surface of second retainer 752 abuts a surface of piston cylinder 748 (e.g., into frictional engagement). The frictional engagement of second retainer 752 with piston cylinder 748 while both are threadably engaged on second eyelet 746 may fix piston cylinder 748 and prevent relative movement of piston cylinder 748 with respect to second eyelet 746.

Piston cylinder 748 may have an open interior (e.g., bore 749 extending into piston cylinder 748 at a second end of piston cylinder 748) for receiving piston 747. Piston 747 may have an opening (e.g., aperture 753 extending through a second end of piston 747). Piston cylinder 748 may have an opening (e.g., aperture 754 extending through the second end of piston cylinder 748). Apertures 753, 754 may extend orthogonally to bore 749. The second end of piston 747 may be inserted into bore 749 (e.g., until aperture 753 of piston 747 aligns with aperture 754 of piston cylinder 748). A wrist pin 755 may be inserted into the aperture 754 of piston cylinder 748 and/or into the aperture 753 of piston 747 (e.g., during alignment of apertures 753, 754) to retain piston 747 within piston cylinder 748.

Wrist pin 755 may be sized and dimensioned to fit snuggly within aperture 753. Wrist pin 755 may be retained within aperture 753 by a detent, screw, pin, frictional engagement or other fastening means (e.g., third retainer 759). Wrist pin 755 may be sized and dimensioned to extend outward from aperture 753 and through aperture 754 of piston cylinder 748 (e.g., on one or both ends of wrist pin 755). Aperture 754 may be sized and dimensioned to slotted and/or to be much larger in dimension than wrist pin 755. The clearance between the dimension of wrist pin 755 and the dimension of aperture 754 may enable piston 747 to move with respect to piston cylinder 748 (e.g., piston 747 may translate and/or move linearly with respect to piston cylinder 748) as wrist pin 755 moves within aperture 754 of piston cylinder 748.

Piston 747 and piston cylinder 748 may be biased into a first position (e.g., as exemplified in FIG. 7). Biasing may be provided for by a biasing means (e.g., a spring 756 may be positioned so as to bias piston 747 and piston cylinder 748 into the first position). The spring 756 may be retained between first retainer 751 and piston cylinder 748. First retainer 751 may have a retaining surface 757 shaped and dimensioned to receive and/or align spring 756. Piston cylinder 748 may have a retaining surface 758 shaped and dimensioned to receive and/or align spring 756. Spring 756 may be retained and/or aligned between retaining surface 757 of first retainer 751 and retaining surface 758 of piston cylinder 748. The shape and/or dimension of the retaining surfaces 757, 758 may include one or more of a lip extending around an outer perimeter thereof, a lip extending around an inner perimeter thereof, and a trough extending into the surface thereof for receiving spring 756.

Spring 756 may bias the retaining surfaces 757, 758 away from each other. Spring 756 may bias first retainer 751, piston 747 and/or first eyelet 745 in a direction opposite from second retainer 752, piston cylinder 748 and/or second eyelet 746. When linkage 734 is installed on a skateboard, tipping of the deck and/or rotation of the axle may cause linkage 734 to undergo changes in forces applied to linkage 734 (e.g., compression). If the forces applied to linkage 734 exceed the biasing force of spring 756, spring 756 may be deformed (e.g., compressed), such that piston 747 may move with respect to piston cylinder 748 (e.g., to a second position).

During deformation of spring 756, piston 747 may move in or out of bore 749 of piston cylinder 748. Piston 747 may move between the first position and the second position, or any intermediate position between the first position and the second position. The first position may correspond to the wrist pin 755 disposed at one side of aperture 754, and the second position may correspond to the wrist pin 755 disposed at an opposing side of aperture 754. The first position may correspond to a specified distance between the retaining surfaces 757, 758, and the second position may correspond to a different distance between the retaining surfaces 757, 758 (e.g., a larger distance). The first position may correspond to a specified distance between the first and second eyelets 745, 746, and the second position may correspond to a different distance between the first and second eyelets 745, 746 (e.g., a larger distance).

Figure 8:
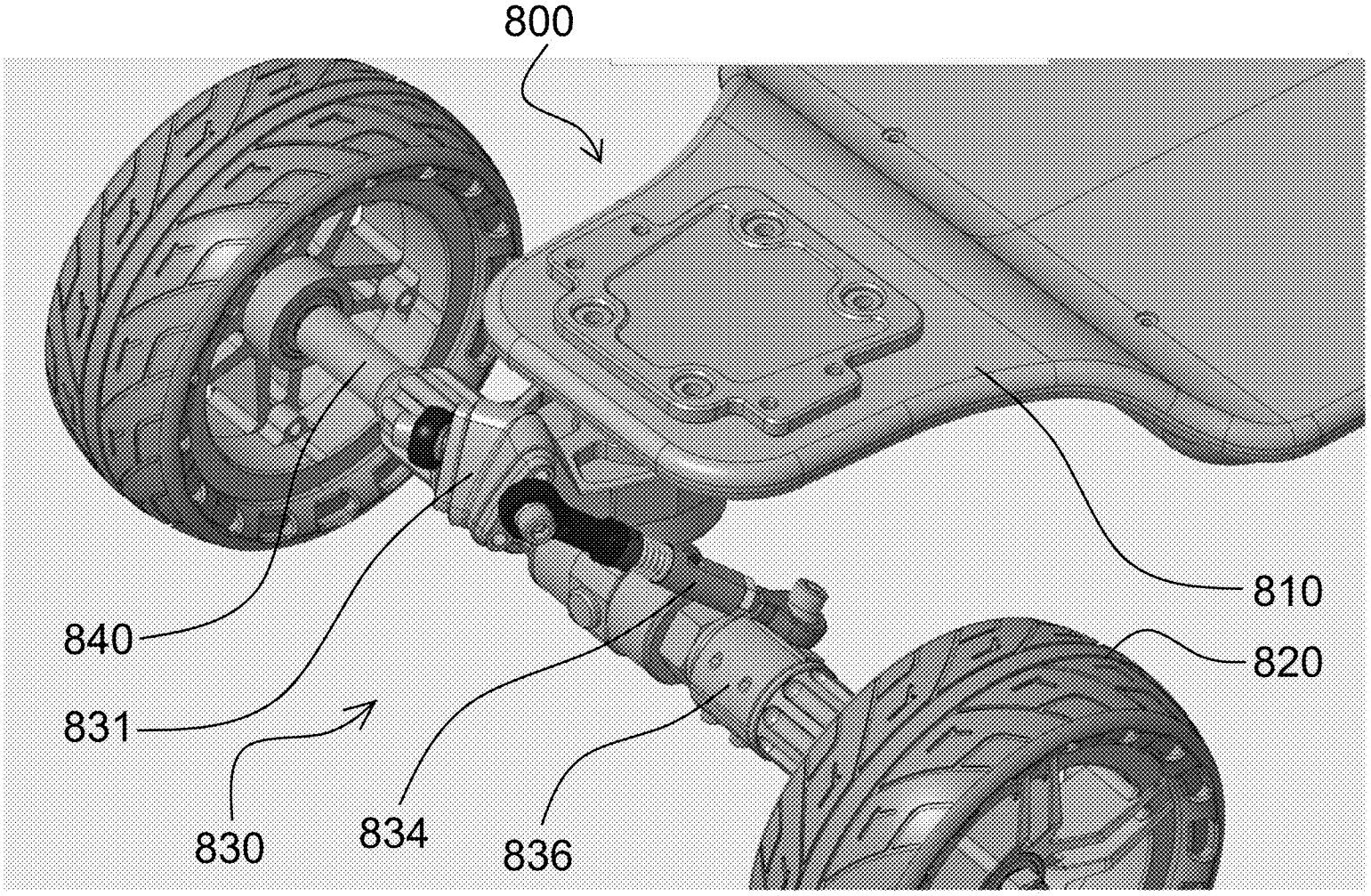
FIG. 8 illustrates a perspective view of a tuck used for coupling wheels and a deck of a skateboard

FIG. 8 illustrates a perspective view of a truck 830 used for coupling wheels 820 and a deck 810 of a skateboard 800. Truck 830 may include a base plate 831. Base plate 831 may be secured to the bottom side of deck 810, though other orientations are possible. An axle 840 may be configured below base plate 831. Axle 840 may be interconnected with base plate 831 as presented in this disclosure, such as by a rotational shaft (e.g., shaft 133 of FIG. 1). Axle 840 may be configured for rotational movement with respect to base plate 831 (e.g., about a horizontal axis).

Axle 840 may further be interconnected with base plate 831 by one or more linkages 834 (e.g., linkages resembling linkage 734 of FIG. 7). A first end of linkage 834 may be secured to base plate 831. A second end of linkage 834 may be secured to axle 840 (e.g., secured to a sleeve 836 which is secured to axle 840). The one or more linkages 834 may stabilize movement of axle 840 with respect to base plate 831 and/or to skateboard 800.

When linkage 834 is installed on a skateboard, tipping of the deck and/or rotation of the axle may cause linkage 834 to undergo changes in forces applied to linkage 834 (e.g., compression). Turning of axle 840 rightward (e.g., right wheel moving rearwardly and left wheel moving forwardly with respect to deck 810) may cause a change in the forces applied to linkage 834. Linkage 834 may be compressed. A piston (e.g., piston 747 of FIG. 7) may be pushed into a piston cylinder (e.g., piston cylinder 748 of FIG. 7), such that a spring (e.g., spring 756 of FIG. 7) may be compressed. Turning of axle 840 leftward (e.g., right wheel moving forwardly and left wheel moving rearwardly with respect to deck 810) may cause a change in the forces applied to linkage 834. Linkage 834 may be expanded. A piston (e.g., piston 747 of FIG. 7) may be pulled away from piston cylinder (e.g., piston cylinder 748 of FIG. 7), such that a spring (e.g., spring 756 of FIG. 7) may be expanded. In this way, linkage 834 (e.g., and spring 756) may bias axle 840 into an orthogonal direction with respect to the long dimension of deck 810. Tipping of deck 810 by a user of the skateboard 800 may cause rotation of axle 840 as presented in this disclosure (e.g., about a vertical axis). Tipping of deck 810 may further cause an opposing force to the bias caused by the one or more linkages 834, and may further stabilize axle 840 and improve operability during use.

Figure 9:
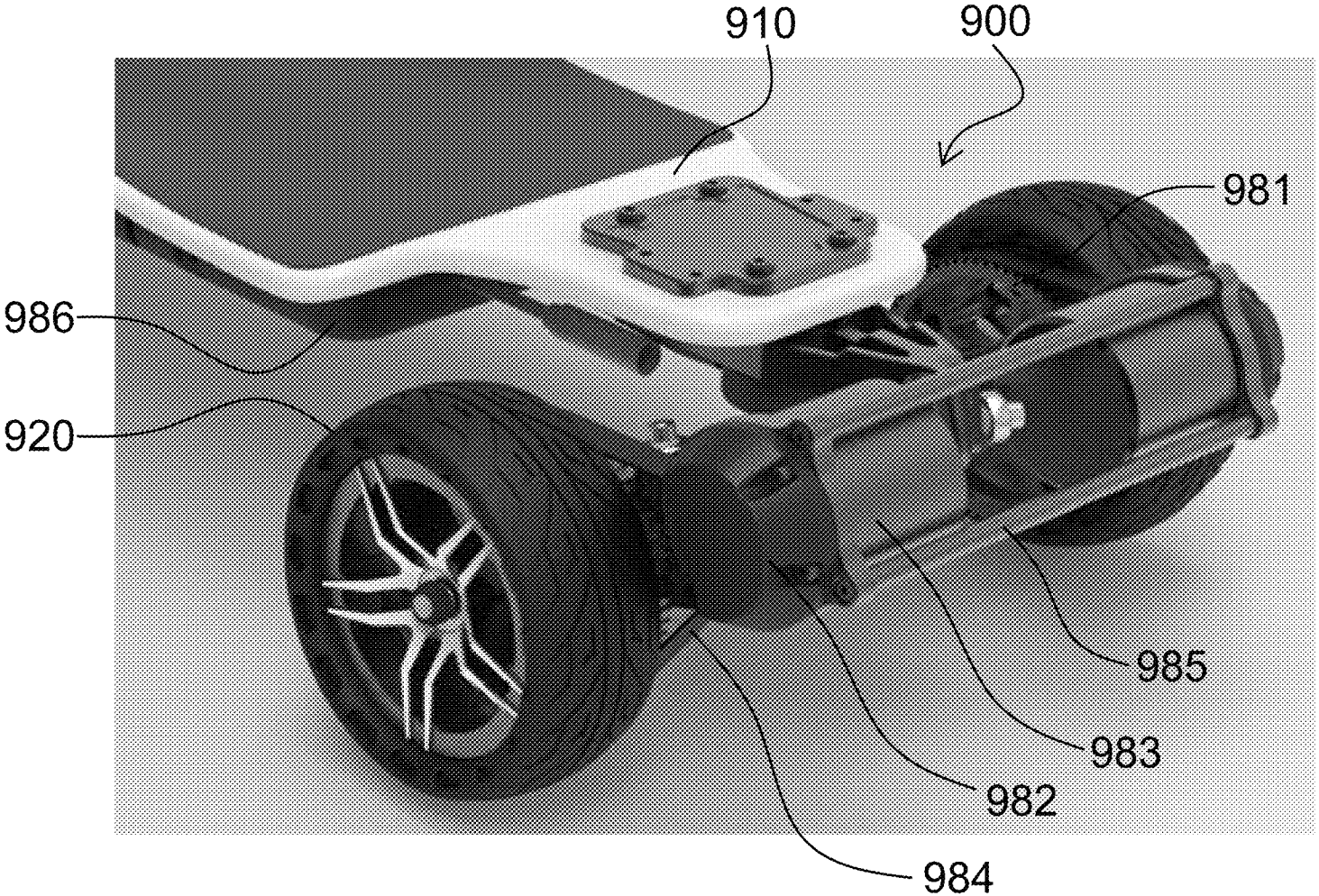
FIG. 9 illustrates a rear view of an electric skateboard assembly.

FIG. 9 illustrates a rear isometric view of an electric skateboard assembly 900. The skateboard 900 may have similar features to those presented in this disclosure. Further, skateboard 900 may include one or more wheels 920 positioned on opposing sides of an axle (e.g., axle 840 of FIG. 8). One or more motion transmitters 981 (e.g., a gears, camshafts, sprockets, and/or pulleys) may be secured to the shaft and configured to rotate with the one or more wheels 920. The one or more wheels 920 may rotate in a fixed rotation with each other, or may rotate independently of each other. Thus, the assembly may include a motion transmitter 981 for each wheel 920, and the rotation of each motion transmitter 981 may fixed to and/or correspond with a specific wheel 920.

One or more motor brackets 982 may be secured to the axle (e.g., to a spacer, such as spacer 138 of FIG. 1). Motor bracket 982 may be fixed against rotation, and may remain stationary with respect to the axle and/or the one or more motion transmitters 981. A motor bracket 982 may be positioned adjacent to each motion transmitter 981.

A motor 983 may be secured to each motor bracket 982. Motor 983 may have a frame that houses the motorization components. Motor 983 may be an electric motor, though this disclosure contemplates the use of various kinds of motors. Motor 983 may include a rotor that moves rotationally during operation of motor 983. The rotor may extend outward from the frame. A motion transmitter (e.g., a gears, camshafts, sprockets, and/or pulleys) may be secured to the rotor where the rotor extends out of the frame. Motor 983 may be secured to motor bracket 982 so that the motion transmitter of motor 983 aligns or substantially aligns with motion transmitter 981.

Motion transmitter 981 may directly contact the motion transmitter of motor 983. Motion transmitter 981 may be spaced apart from the motion transmitter of motor 983, and a loop 984 (e.g., a belt, chain, or other means of interconnection) may extend from motion transmitter 981 to the motion transmitter of motor 983 to create an interconnection. Motive force may be provided by motor 983 to cause rotation of wheels 920. When activated, the rotor of motor 983 may rotate. This rotation may be transferred to the motion transmitter of motor 983 (e.g., causing the motion transmitter to rotate). The rotational motion of the motion transmitter may be transferred directly to motion transmitter 981 or indirectly via loop 984 (e.g., causing motion transmitter 981 to rotate). Where the relative rotation of wheel 920 and motion transmitter 981 is fixed, rotation of motion transmitter 981 may cause a corresponding rotation of wheel 920.

The rotation created by motor 983 may be stepped up and/or stepped down through the use of differently sized motion transmitters (e.g., using a gear box). The motion transmitter of motor 983 may be relatively small, whereas motion transmitter 981 may be relatively large. Thus, a full rotation of the rotor of motor 983 may correspond to less than a full rotation of wheel 920 (e.g., stepping down the speed of rotation). Other configurations are contemplated by this disclosure.

One or more stabilizers 985 may be used to further stabilize and prevent relative movement of motors 983 and/or motor brackets 982. Stabilizers 985 are exemplified as extending between a first motor bracket 982 and a second motor bracket (not numbered), though other configurations are possible to achieve greater stabilization of motors 983 and/or motor brackets 982.

One or more batteries may be secured to skateboard 900. The one or more batteries may be secured to a deck 910 of skateboard 900 (e.g., to an underside of deck 910). Electrical wiring may be used to electrically couple the one or more motors 983 to the one or more batteries 986 to provide electrical energy to power the one or more motors 983.

Other aspects will be apparent to those skilled in the art from consideration of the specification and practice disclosed herein. It is intended, therefore, that the specification and illustrated embodiments be considered as examples only.

What is claimed is:

1. A skateboard, comprising:
- a deck;
- one or more wheels; and
- a truck coupled to the deck and coupled to the one or more wheels, the truck having:
  - a base plate coupled to the deck,
  - an axle coupled to the one or more wheels,
  - a shaft extending from the base plate to the axle, the shaft capable of rotational movement with respect to the base plate about a first axis, and the axle capable of rotational movement with respect to the shaft about a second axis not parallel to the first axis, and
  - one or more linkages extending from the base plate toward the axle to cause turning of the axle in response to tilting of the base plate.

2. The skateboard of claim 1, having one or more bushings positioned adjacent to the shaft, and having one or more securing rings positioned adjacent to the one or more bushings, respectively.

3. The skateboard of claim 1, having one or more sleeves secured around the shaft, and wherein the one or more linkages extend from the base plate to the one or more sleeves, respectively.

4. The skateboard of claim 3, wherein the one or more sleeves have one or more connection points for interconnection of the one or more linkages.

5. The skateboard of claim 1, wherein the base plate has one or more connection points for interconnection of the one or more linkages.

6. The skateboard of claim 1, having a top plate positioned above the deck, and wherein the top plate and the base plate are secured to each other through the deck.

7. The skateboard of claim 1, having one or more shocks extending from the base plate to the axle in a manner permitting rotation of the axle and biasing axle into an orthogonal position with respect to a long dimension of the deck.

8. The skateboard of claim 1, wherein the one or more linkages each include a piston extending from one end into a piston cylinder extending from the other end, wherein a spring biases the piston and piston cylinder into a first position, and wherein tipping of the deck forces the piston and piston cylinder into a second position.

9. The method of claim 1, wherein tilting the base plate causes the shaft to rotate with respect to the axle, wherein tilting the base plate causes the one or more linkages to push and/or pull opposing sides of the axle causing the axle to rotate with respect to the long dimension of the truck, and wherein rotation of the axle causes the shaft to rotate with respect to the base plate.

10. A skateboard truck coupled to a deck and one or more wheels, the truck comprising:

a base plate coupled to the deck;

an axle coupled to the one or more wheels;

a shaft extending from the base plate to the axle, the shaft capable of rotational movement with respect to the base plate about a first axis, and the axle capable of rotational movement with respect to the shaft about a second axis not parallel to the first axis; and one or more linkages extending from the base plate toward the axle to cause turning of the axle in response to tilting of the base plate.

11. The skateboard of claim 10, having one or more sleeves secured around the shaft, and wherein the one or more linkages extend from the base plate to the one or more sleeves, respectively.

12. The skateboard of claim 11, wherein the one or more sleeves have one or more connection points for interconnection of the one or more linkages.

13. The skateboard of claim 10, wherein the base plate has one or more connection points for interconnection of the one or more linkages.

14. The skateboard truck of claim 10, wherein the one or more linkages each include a piston extending from one end into a piston cylinder extending from the other end, wherein a spring biases the piston and piston cylinder into a first position, and wherein tipping of the deck forces the piston and piston cylinder into a second position.

15. The skateboard truck of claim 10, wherein tilting the base plate causes the shaft to rotate with respect to the axle, wherein tilting the base plate causes the one or more linkages to push and/or pull opposing sides of the axle causing the axle to rotate with respect to the long dimension of the skateboard truck, and wherein rotation of the axle causes the shaft to rotate with respect to the base plate.

16. A method of assembling a skateboard truck, the method comprising:

providing a base plate;

extending a shaft from the base plate, the shaft configured for rotational movement with respect to the base plate about a first axis;

extending the shaft to an axle, the axle configured for rotational movement with respect to the shaft about a second axis not parallel to the first axis; and providing one or more linkages extending from the base plate toward the axle to cause turning of the axle in response to tilting of the base plate.

17. The skateboard of claim 16, further including:

providing one or more sleeves secured around the shaft, wherein the one or more linkages extend from the base plate to the one or more sleeves, respectively.

18. The method of claim 16, further including:

providing a piston extending from one end of the one or more linkages;

providing a piston cylinder extending from the other end of the one or more linkages;

extending the piston into the piston cylinder; and biasing the piston and piston cylinder into a first position with a spring.

19. The method of claim 18, wherein the piston and piston cylinder are biased into a second position by tilting the base plate.

20. The method of claim 16, wherein tilting the base plate causes the shaft to rotate with respect to the axle, wherein tilting the base plate causes the one or more linkages to push and/or pull opposing sides of the axle causing the axle to rotate with respect to the long dimension of the skateboard truck, and wherein rotation of the axle causes the shaft to rotate with respect to the base plate.

* * * * *